US012123270B2

(12) United States Patent
Banditrat

(10) Patent No.: US 12,123,270 B2
(45) Date of Patent: Oct. 22, 2024

(54) SELF-ORIENTING CASING ENTRY TOOL, AND SYSTEM

(71) Applicant: Baker Hughes Oilfield Operations LLC, Houston, TX (US)

(72) Inventor: Thomas Banditrat, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/181,169

(22) Filed: Mar. 9, 2023

(65) Prior Publication Data

US 2024/0301758 A1 Sep. 12, 2024

(51) Int. Cl.
*E21B 23/00* (2006.01)

(52) U.S. Cl.
CPC ..... *E21B 23/00* (2013.01)

(58) Field of Classification Search
CPC ..... E21B 43/10; E21B 23/00; E21B 41/00
See application file for complete search history.

(56) References Cited

U.S. PATENT DOCUMENTS 4,415,030 A * 11/1983 Walkow ..... E21B 17/1057 166/241.5
5,456,317 A 10/1995 Hood, III et al.
7,395,881 B2 * 7/2008 McKay ..... E21B 17/1057 166/241.3
2008/0156479 A1 7/2008 Cassidy et al.
2015/0144354 A1 * 5/2015 Cooper ..... E21B 31/00 166/54.5
2020/0284118 A1 * 9/2020 Xiao ..... E21B 33/0407
2021/0332654 A1 10/2021 Patterson
2022/0275709 A1 9/2022 Glaser et al.
2024/0068364 A1 * 2/2024 Milkovisch ..... E21B 49/06

FOREIGN PATENT DOCUMENTS

WO 2019094048 A1 5/2019

OTHER PUBLICATIONS

Notification of Transmittal of the International Search Report and the Written Opinion of the International Searching Authority, or the Declaration; PCT/US2024/018287; Mail date: Jul. 3, 2024; 11 pages.

* cited by examiner

*Primary Examiner* — Brad Harcourt
(74) *Attorney, Agent, or Firm* — Baker Hughes Patent Organization

(57) ABSTRACT

A self-orienting casing entry tool, including a mule shoe body having an angled nose terminating the body creating a first relatively longitudinally shorter portion of the body and a second relatively longitudinally longer portion of the body, wherein the first portion of the body is made of a material, the first portion having a density, and the second portion of the body is made of the same material, the second portion configured to exhibit a lesser density. A method for entering a predisposed casing in a deviated borehole including running a tool at the front of a string being run in the borehole, floating the tool into an orientation where the mule shoe body will enter the predisposed casing. A borehole system including a borehole in a subsurface formation, a string in the borehole, and a self-orienting casing entry tool disposed as a part of the string.

15 Claims, 3 Drawing Sheets

SELF-ORIENTING CASING ENTRY TOOL, AND SYSTEM

BACKGROUND

In the resource recovery and fluid sequestration industries, there is often need to enter one tubular structure with another in the downhole environment. A fair percentage of such entries occur in highly deviated boreholes. Entering tubulars in such boreholes tend to sag to the low side of the borehole making entry into another tubular, such as a previously installed casing, more difficult. Mule shoes are used to help the situation by providing a ramp by which the entering tubular may be lifted into the tubular to be entered. Most of the time such mule shoes work well but occasionally, the mule shoe itself makes contact with the tubular to be entered at a position in which the mule shoe cannot assist in the entry. Various mechanical means have been used to address this but still require more rig time than desirable. Accordingly, the art will well receive alternatives that improve entry and reduce rig time.

SUMMARY

An embodiment of a self-orienting casing entry tool, including a mule shoe body having an angled nose terminating the body creating a first relatively longitudinally shorter portion of the body and a second relatively longitudinally longer portion of the body, wherein the first portion of the body is made of a material, the first portion having a density, and the second portion of the body is made of the same material, the second portion configured to exhibit a lesser density.

An embodiment of a method for entering a predisposed casing in a deviated borehole including running a tool at the front of a string being run in the borehole, floating the tool into an orientation where the mule shoe body will enter the predisposed casing.

An embodiment of a borehole system including a borehole in a subsurface formation, a string in the borehole, and a self-orienting casing entry tool disposed as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
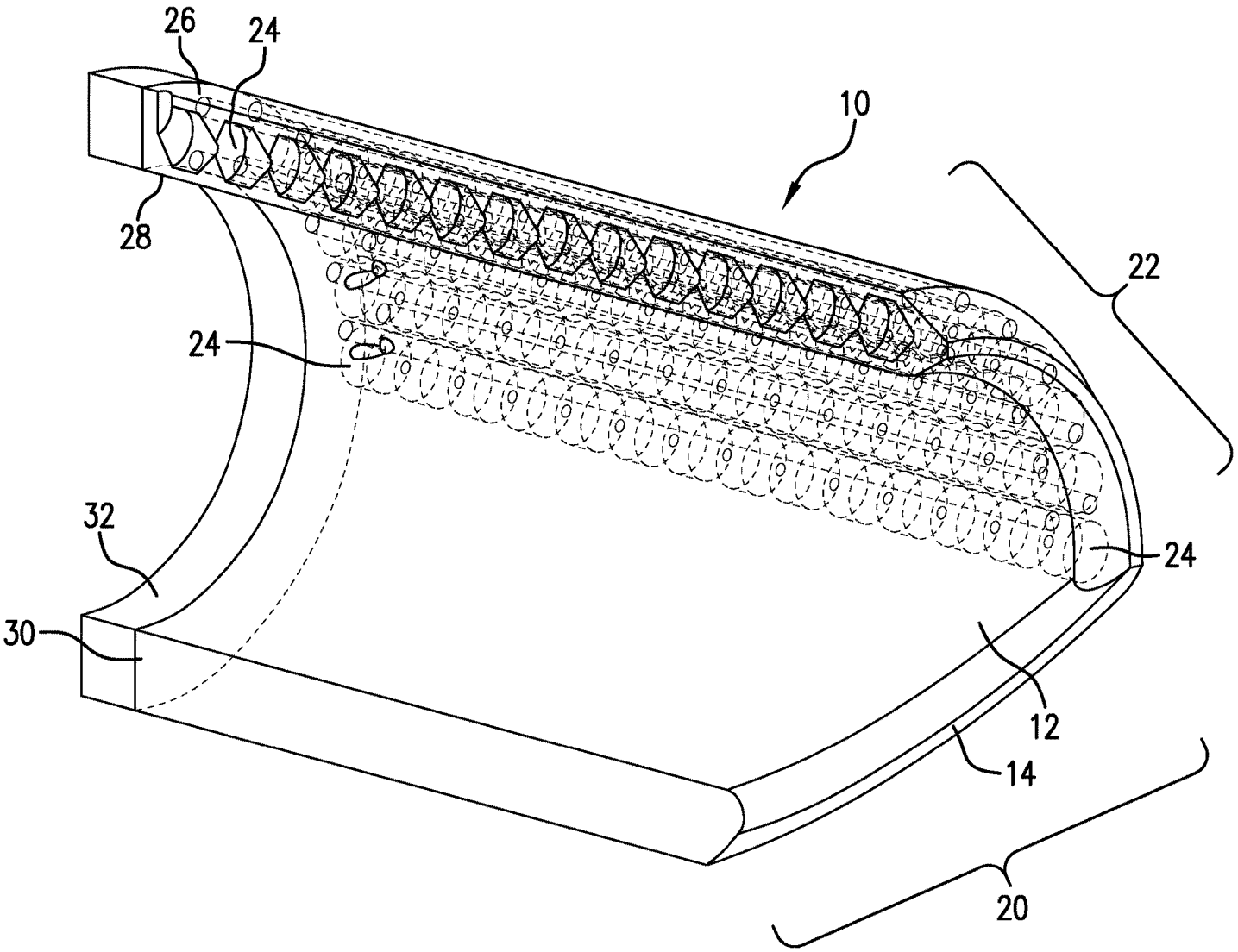
FIG. 1 is a sectional transparent view of a self-orienting casing entry tool as disclosed herein.
Figure 2:
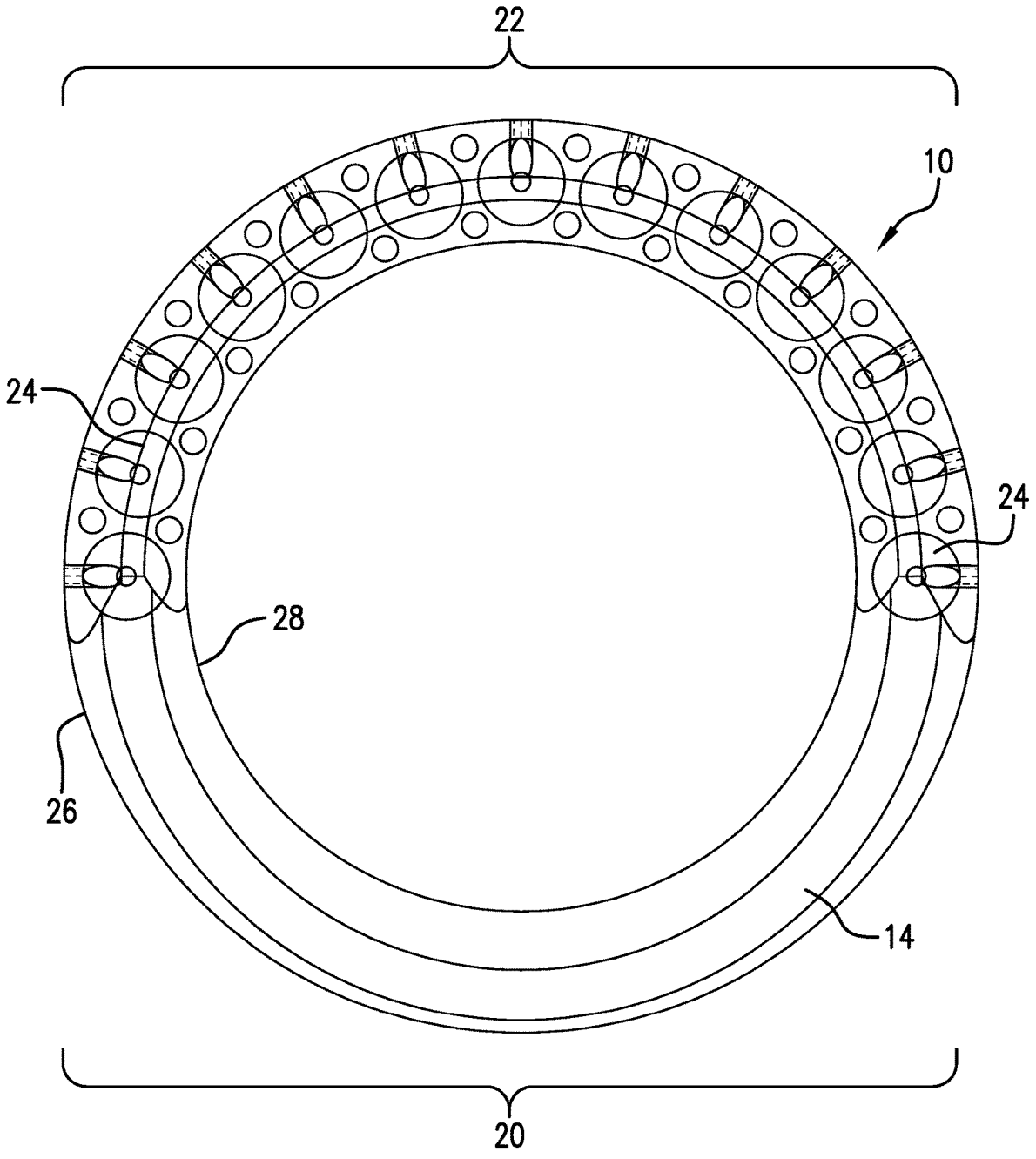
FIG. 2 is a transparent end view of the tool illustrated in FIG. 1.

Referring to FIGS. 1 and 2, a self-orienting casing entry tool 10 is illustrated. The tool 10 comprises a body 12 that will be familiar to those of skill in the art and known colloquially as a mule shoe. Essentially, a mule shoe is a cylindrical shape that is cut at an angle creating an angled nose 14. The angled nose helps lift a string 16 (see FIG. 3) into a preexisting casing (not shown) when the string 16 happens to be off center. Keeping the pointed side of the nose 14 toward the center of a borehole 18 (again see FIG. 3) where the nose 14 is to engage the preexisting casing. In a highly deviated borehole, this may be problematic. The tool 10 includes a changing density about the body 12. Specifically, a first portion 20 of the body, which is the shorter longitudinal section of the body 12 is made of a material, such as metal for example that is of a standard solid configuration. The first portion 20 necessarily has a density. A second portion 22 of the body, the longitudinally longer section of the body, is made of the same material, but the second portion is configured to exhibit a lesser density. This is accomplished by removing material from within the second portion 22. Removed material may be described as a hollow 24 of any geometry and size within the bounds of a radially outward surface 26 and a radially inward surface 28. The larger the hollow 24 is, the lower the density of the portion 22 is, but mechanical strength may be diminished. Hence, there should be consideration of how much mechanical strength is desired for the particular purpose and how much density reduction is required in order to essentially float the tool 10 into the correct orientation. Determining this is within the level of skill in the art once that person understands the inventive concept. With this information the amount of removed material can be decided. In an embodiment, as illustrated in FIGS. 1 and 2, a plurality of hollows 24 are distributed through the portion 22. The illustrated hollows 24 are spherical though other geometries are also contemplated. Since there is more material extending between surface 26 and 28 where a plurality of hollows are used rather than a single large hollow, mechanical strength is increased though density decrease relative to portion 20 is less. In this embodiment, the hollows 24 are also joined to one another to create a longitudinal pathway. This is useful if a powder bed additive manufacturing method is used to create the tool 10. The unfused powdered material that would be disposed in the spheres needs to come out to reduce density of portion 22, so the joined speres allows a pathway to exist to dump the unfused powder out an end 30 of tool 10.

In an embodiment, a bearing 32 is attached to end 30 to allow free rotation of the tool 10 when connected to a string in use. This promotes the ability of the tool 10 to react to the fluid in the borehole to float its way into the proper orientation for entering the predisposed casing.

Figure 3:
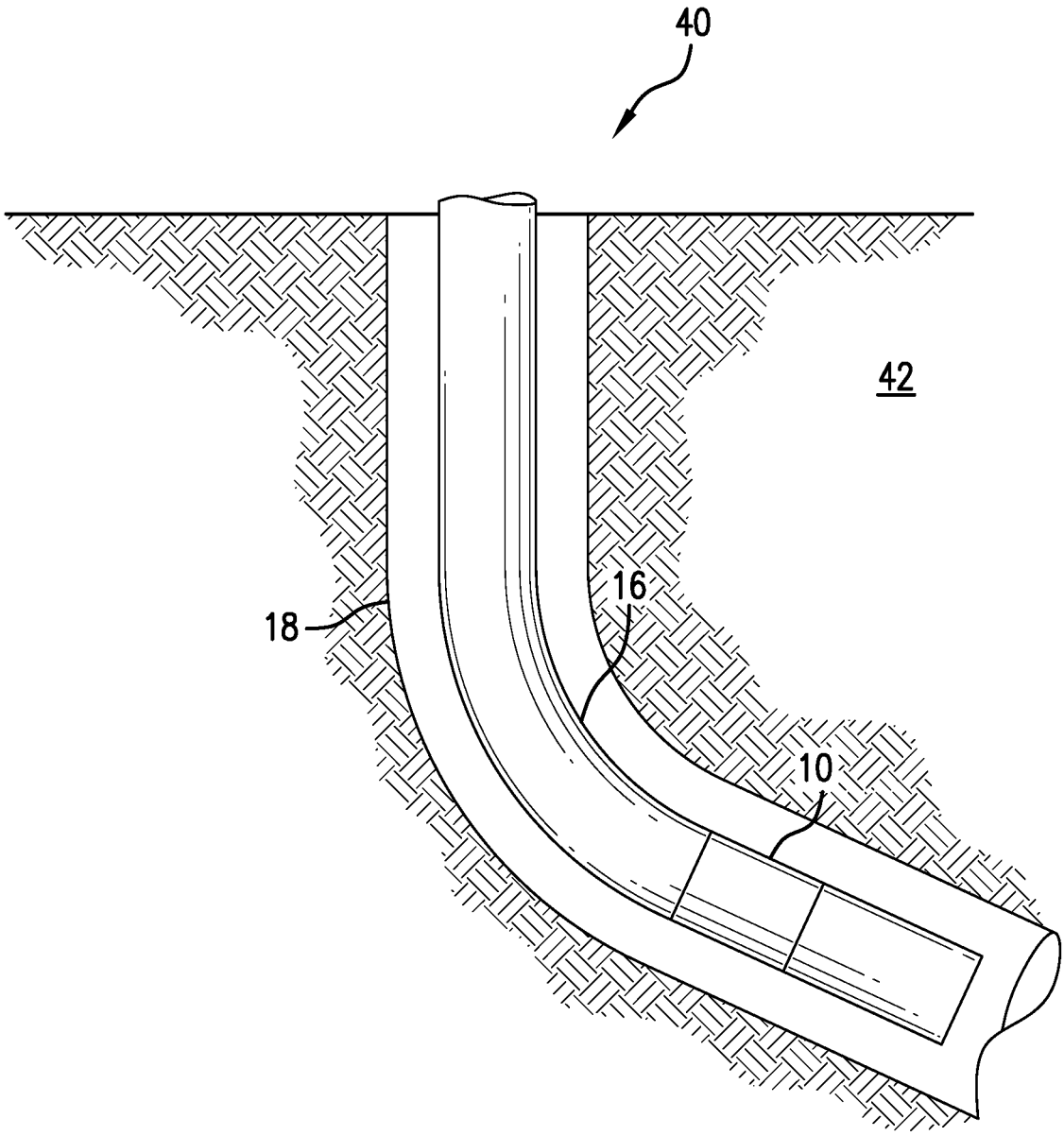
FIG. 3 is a view of a borehole system including the self-orienting casing entry tool as disclosed herein.

Referring to FIG. 3, a borehole system 40. The system 40 comprises a borehole 18 in a subsurface formation 42. A string 16 is disposed within the borehole 18. A self-orienting casing entry tool as disclosed herein is disposed as a part of the string 16.

Set forth below are some embodiments of the foregoing disclosure:

Embodiment 1: A self-orienting casing entry tool, including a mule shoe body having an angled nose terminating the body creating a first relatively longitudinally shorter portion of the body and a second relatively longitudinally longer portion of the body, wherein the first portion of the body is made of a material, the first portion having a density, and the second portion of the body is made of the same material, the second portion configured to exhibit a lesser density.

Embodiment 2: The tool as in any prior embodiment, wherein the configuration to exhibit the lesser density is a hollow within the second portion.

Embodiment 3: The tool as in any prior embodiment, wherein the hollow is a plurality of hollows within a thickness of the second portion.

Embodiment 4: The tool as in any prior embodiment, wherein the plurality of hollows include spherical hollows.

Embodiment 5: The tool as in any prior embodiment, wherein the spherical hollows are identical in size to one another.

Embodiment 6: The tool as in any prior embodiment, wherein all of the plurality of hollows are spherical.

Embodiment 7: The tool as in any prior embodiment, wherein the plurality of hollows are distributed within the second portion and cover half of the body.

Embodiment 8: The tool as in any prior embodiment, wherein the lesser density is less than a density of ambient fluid surrounding the tool when in use.

Embodiment 9: The tool as in any prior embodiment, wherein the first portion exhibits a density greater than a density of ambient fluid surrounding the tool when in use.

Embodiment 10: The tool as in any prior embodiment, further comprising a bearing disposed at the body allowing the body to rotate freely from a string upon which the body is mounted, during use.

Embodiment 11: A method for entering a predisposed casing in a deviated borehole including running a tool as in any prior embodiment at the front of a string being run in the borehole, floating the tool into an orientation where the mule shoe body will enter the predisposed casing.

Embodiment 12: The method as in any prior embodiment, further including freely rotating the mule shoe body on a bearing pursuant to buoyant forces on the mule shoe body dictated by the first portion density and the second portion density.

Embodiment 13: A borehole system including a borehole in a subsurface formation, a string in the borehole, and a self-orienting casing entry tool as in any prior embodiment disposed as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A self-orienting casing entry tool, comprising:

a mule shoe body having an exterior surface that is tubular, the body configured for connection to a tubular string, the body having an angled nose terminating the body creating a first relatively longitudinally shorter portion of the body and a second relatively longitudinally longer portion of the body, wherein:

the first portion of the body is made of a material, the first portion having a density; and the second portion of the body is made of the same material, the second portion configured to exhibit a lesser density.

2. The tool as claimed in claim 1, wherein the configuration to exhibit the lesser density is a hollow within the second portion.

3. The tool as claimed in claim 2, wherein the hollow is a plurality of hollows within a thickness of the second portion.

4. The tool as claimed in claim 3, wherein the plurality of hollows include spherical hollows.

5. The tool as claimed in claim 4, wherein the spherical hollows are identical in size to one another.

6. The tool as claimed in claim 3, wherein all of the plurality of hollows are spherical.

7. The tool as claimed in claim 3, wherein the plurality of hollows are distributed within the second portion and cover half of the body.

8. The tool as claimed in claim 1, wherein the lesser density is less than a density of ambient fluid surrounding the tool when in use.

9. The tool as claimed in claim 1, wherein the first portion exhibits a density greater than a density of ambient fluid surrounding the tool when in use.

10. The tool as claimed in claim 1, further comprising a bearing disposed at the body allowing the body to rotate freely from a string upon which the body is mounted, during use.

11. A method for entering a predisposed casing in a deviated borehole comprising:

running a tool as claimed in claim 1 at the front of a string being run in the borehole;

floating the tool into an orientation where the mule shoe body will enter the predisposed casing.

12. The method as claimed in claim 11, further including freely rotating the mule shoe body on a bearing pursuant to buoyant forces on the mule shoe body dictated by the first portion density and the second portion density.

13. A borehole system comprising:

a borehole in a subsurface formation;

a string in the borehole; and a self-orienting casing entry tool as claimed in claim 1 disposed as a part of the string.

14. A self-orienting casing entry tool, comprising:

a mule shoe body having an angled nose terminating the body creating a first relatively longitudinally shorter portion of the body and a second relatively longitudinally longer portion of the body, wherein:

the first portion of the body is made of a material, the first portion having a density; and the second portion of the body is made of the same material, the second portion including a plurality of hollows that includes spherical hollows within a thickness of the second portion to exhibit a lesser density than the first portion.

15. A self-orienting casing entry tool, comprising:

a mule shoe body having an angled nose terminating the body creating a first relatively longitudinally shorter portion of the body and a second relatively longitudinally longer portion of the body, wherein:

the first portion of the body is made of a material, the first portion having a density;

the second portion of the body is made of the same material, the second portion including a plurality of hollows that includes spherical hollows within a thickness of the second portion to exhibit a lesser density than the first portion, wherein the plurality of hollows are distributed within the second portion and cover half of the body.

* * * * *